United States Patent [19]

Jones

[11] Patent Number: 4,889,383

[45] Date of Patent: Dec. 26, 1989

[54] FOLDING CHAIR

[76] Inventor: Deryl K. Jones, 336-B 16th Ave. S., Surfside Beach, S.C. 29575

[21] Appl. No.: 351,481

[22] Filed: May 15, 1989

[51] Int. Cl.[4] ..... A47C 4/00

[52] U.S. Cl. ..... 297/16; 297/17; 297/45; 297/54

[58] Field of Search ..... 297/16, 17, 54, 45

[56] References Cited

U.S. PATENT DOCUMENTS

| | | | |
|---|---|---|---|
| 1,379,285 | 5/1921 | Pewther | 297/54 |
| 2,490,367 | 12/1949 | Maddocks | 297/54 |
| 4,605,261 | 8/1986 | Lee | 297/16 |
| 4,773,708 | 9/1988 | Nastu | 297/17 |

*Primary Examiner*—Francis K. Zugel
*Attorney, Agent, or Firm*—Charles S. McGuire

[57] ABSTRACT

A folding chair construction comprising a plurality of substantially U-shaped portions, each having a pair of parallel side sections connected by a right angle corner member to a medial section, providing back and seat portions and front and rear legs hingedly connected for movement between a folded position, wherein all of the U-shaped portions are superposed with one another, and an erected position, wherein the U-shaped portions are relatively angularly disposed. The side sections of the back and seat portions and the medial sections of all portions are formed of tubular members connected for relative, telescoping movement between extended and retracted positions when the chair is in the unfolded and folded positions, respectively. A flexible fabric support portion is permanently secured to the back and seat portions by outwardly extending portions of the fabric which are looped around the side and medial sections and stitched to themselves. The width of the outwardly extending portions is not substantially greater than the lengths of the side and medial sections about which they are looped when such sections are in their retracted positions.

12 Claims, 2 Drawing Sheets

FOLDING CHAIR

BACKGROUND OF THE INVENTION

The present invention relates to folding chairs, and more specifically to portable chairs having telescoping frame members which may be folded to a very compact position.

The prior art includes folding chair structures of a number of different constructions and configurations. Those known to applicant and considered most closely related to the present invention are disclosed in U.S Pat. Nos. 1,440,248 of Shoemaker, 4,514,009 of Vanderminden et al, and 4,773,708 of Natsu. The patent to Shoemaker discloses a folding chair having telescoping back frame members 16; however, the legs and other frame members must be engaged by locking tabs with circular support members to maintain the chair in the erected position, and disengaged for inward folding movement to place the chair in the folded condition of FIG. 2. The patent of Vanderminden et al includes telescoping arms 21, 22 although the collapsed position of the chair (FIG. 5) is not particularly compact. Another type of folding chair, having a foot section 20 telescopingly connected to the leg side frame members 13a and 13b is disclosed is the Nastu patent.

It is a principal object of the invention to provide a lightweight, easily transportable chair of the lounge-type which may be folded to an extremely compact position.

A further object is to provide a folding chair having telescopingly engaged elements forming back, seat and leg portions which may be axially moved between shortened and lengthened positions, as well as moved pivotally relative to one another between erected and folded positions, in combination with a flexible fabric body support portion.

Another object is to provide a folding chair construction of the aforementioned character in combination with a pouch in which the chair may be placed while in its folded condition for storage or transport.

Other objects will in part be obvious and will in part appear hereinafter.

SUMMARY OF THE INVENTION

In accordance with the foregoing objects, the invention contemplates a folding chair construction wherein a rigid frame is provided by back and seat portions, and front and rear leg means, each comprising a plurality of hollow, tubular members which are telescopingly engaged for sliding, axial movement into and out of one another. The back portion and both the front and rear leg means are connected to the seat portion for pivotal movement with respect thereto between folded and erected positions. Both the back and seat portions include telescoping members axially movable in both the longitudinal and lateral directions, while the leg means each include members telescopingly movable only in the lateral direction.

A support portion of denim, canvas, or other such sturdy but flexible fabric material is permanently attached, as by looping around and stitching, to laterally extending, telescopingly engaged members of the back and seat portions. The width of the fabric material is not more than a few inches greater than the width of the chair when fully folded. Thus, the flexible fabric will be folded or bunched somewhat when the chair is folded, but this does not interfere with folding or unfolding movement.

When the telescoping frame members are moved fully to their inward or retracted positions, and the back portion pivotally folded over and the legs under the seat portion, the chair is extremely compact, for example, on the order of 12"×12"×4". Preferably an open-topped, fabric or vinyl pouch of dimensions for snugly receiving the folded chair is provided in combination therewith. A handle exending over the top of the pouch provides a convenient carrying means. Also, a patch pocket is preferably provided on the outer surface of the fabric support to be positioned on the back of the chair when in the erected position.

FIG. 1 is a perspective view of the folding chair of the invention, shown in the fully erected position;

FIG. 1*a* is a plan view of the flexible fabric support portion of the chair;

DETAILED DESCRIPTION

Figure 1A:
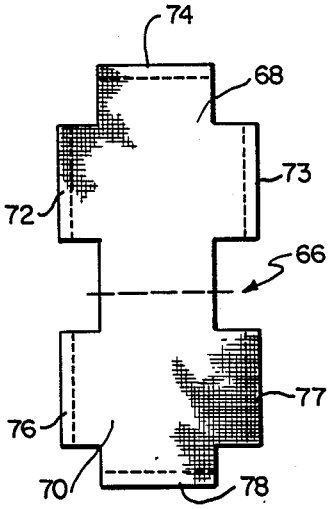
Figure 1:
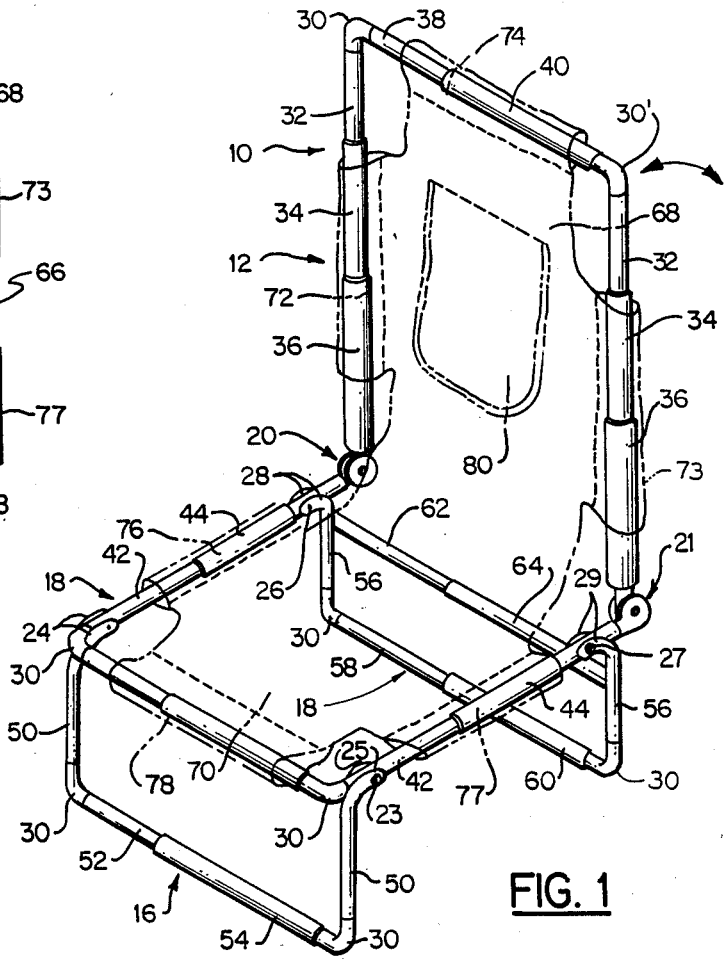
Figure 2:
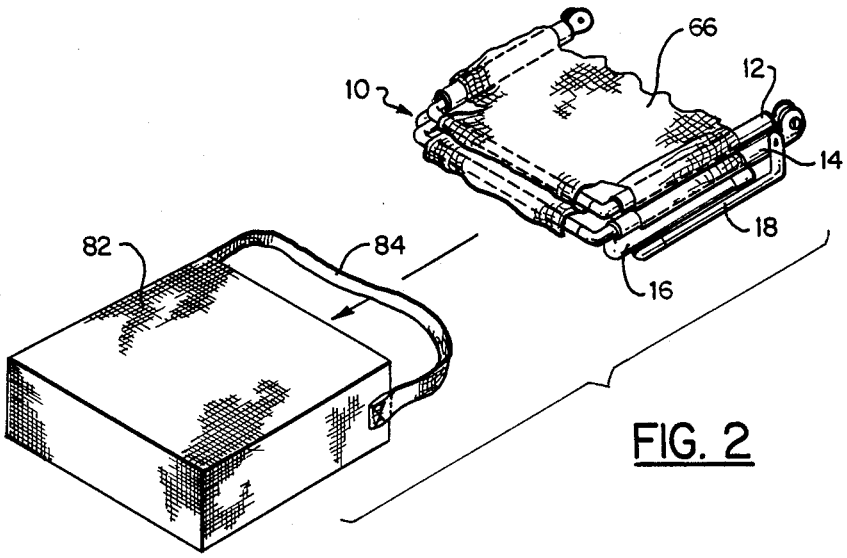
FIG. 2 is a perspective view of the chair in the fully folded position and a storage/carrying pouch.
Figure 4:
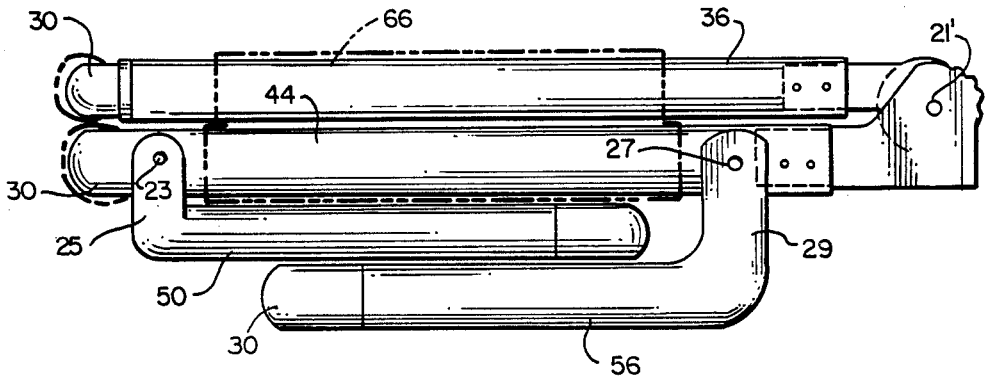
FIG. 4 is a side elevational view of the chair in the fully folded position.

Referring now to the drawings, folding chair 10 includes a rigid frame comprising a back portion 12, seat portion 14, and front and rear leg means 16 and 18, respectively. Back portion 12 is attached to seat portion 14 for relative pivoting movement by means of ratchet-type hinges 20 and 21 which permit the back and seat portions to be folded into superposed positions, as shown in FIGS. 2 and 4, or supported in an upright position, as in FIG. 1. Hinges 20 and 21 are of conventional design, permitting adjusment of the back to several upright positions in different angular relationships to the seat portion.

Front leg means 16 is pivotally connected to seat portion 14 on each side of forward portions thereof by pins 22 and 23, passing through spaced portions 24 and 25, respectively, on opposite ends of leg means 16. Rear leg means 18 is similarly connected to seat portion 14 by pins 26 and 27, passing through spaced portions 28 and 29 of leg means 18 and rear portions of the seat portion. When in the unfolded or fully erected position, portions of seat portion 14 rest upon leg means 16 and 18 between spaced portions 24, 25, 28 and 29, as seen in FIG. 1. Front leg means 16 may be pivotally moved to a folded position, directly under seat portion 14, and rear leg means 18 folded under front leg means 16, portions 28 and 29 being longer than portions 24 and 25 for this purpose, all as seen in FIG. 4.

Figure 3:
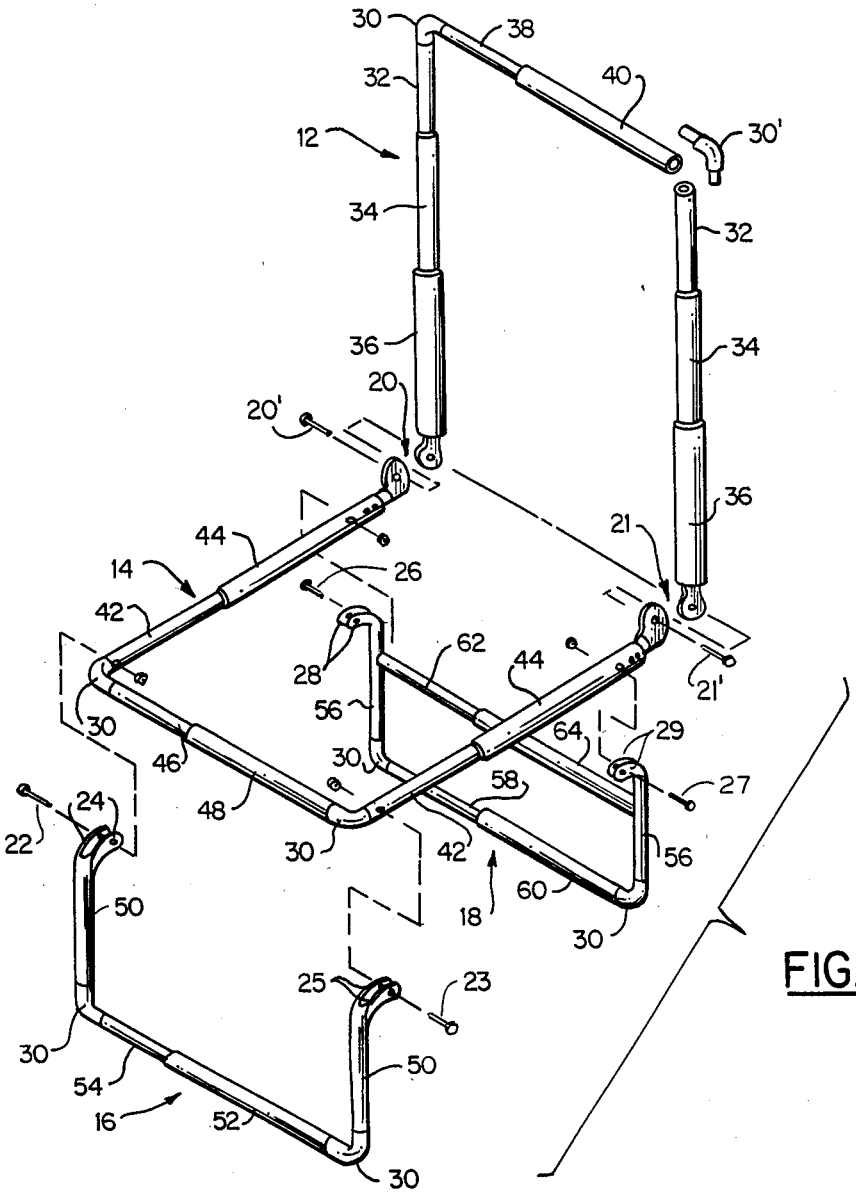
FIG. 3 is an exploded, perspective view of the chair, without the fabric support portion.

It will be noted that all of back and seat portions 12 and 14, and front and rear leg means 16 and 18, are of essentially U-shaped configurations, each having two side sections connected by a medial section. The side and medial sections of back and seat portions 12 and 14, and the medial sections of leg means 16 and 18 are constructed of telescopingly engaged, hollow tubular members which may be moved between relatively extended and retracted positions. The side sections of all U-shaped members of chair 10 are connected to the medial portions by right-angle corner members 30, one of which is shown in FIG. 3 exploded away from the side and medial sections of back portion 12 and denoted by reference numeral 30'. Corner members 30 are permanently secured to the respective side and medial sections by crimping, or by a suitable adhesive, or other conventional means. A dimensional transition between connected tubular members of different diameters is provided by corner members 30. For example, opposite ends of corner member 30' are of different diameters to accommodate the different diameters of tubular sections 32 and 40 which are connected by member 30'.

The side sections of back portion 12 each comprise three tubular sections 32, 34 and 36 of relatively small, medium and large diameters, respectively; the medial section comprises two tubular sections 38 and 40, of relatively small and large diameter, respectively. The side sections of seat portion 14 each are formed of small and large diameter tubular members 42 and 44, and the medial section of tubular sections 46 and 48. The side sections of front leg means 16 are formed of single, tubular sections 50, having spaced portions 24 and 25 formed at the free ends hereof, and the medial section comprises telescopingly engaged, tubular sections 52 and 54. The side sections of rear leg means 18 comprise single, tubular sections 56, having spaced portions 28 and 29, and the medial section comprises telescopingly engaged, tubular sections 58 and 60. For added rigidity, rear leg means 18 includes a cross member, parallel to the medial section, comprising telescopingly engaged, tubular sections 62 and 64, fixedly attached at one end to tubular sections 56. A similar cross member may be provided on front leg means 16, if desired, but will normally not be required.

Back and seat portions 12 and 14, and front and rear leg means 16 and 18 are shown in exploded perspective in FIG. 3, which also provides a clearer view of the elements of rachet hinges 20 and 21. The circular ratchet members are mounted on members engaged in the lower ends of tubular sections 36 of back portion 12 and are pivotally secured by rivets 20' and 21' to upstanding ears on members which are similarly engaged, e.g., by indentations, in the rear ends of tubular members 44 of seat portion 14. As previously mentioned, such hinge constructions are conventional in chairs having relatively foldable back and seat portions.

Suppor portion 66 is shown in FIG. 1 in phantom lines, as it appears when chair 10 is in the fully erected position, and in FIG. 2 as it appears when chair 10 is folded. Support portion 66 is also shown separately in FIG. 1a, and comprises back and seat areas 68 and 70, respectively, made from a unitary piece of sturdy but flexible material, such as canvas, denim, etc. Outwardly extending portions 72, 73 and 74 of back area 68 are looped around the side and medial sections of back portion 12 of the chair frame, and stitched to themselves. Likewise, outwardly extending portions 76, 77 and 78 of seat area 70 are looped around the side and medial sections of seat portion 14 and stitched o themselves, whereby support portion 66 is fixedly attached to the frame of chair 10.

A preferred option is the provision of bag 82, having attached carrying strap or handle 84, as shown in FIG. 2. As an additional, preferred option, pocket 80 is stitched to the outer (rear) surface of back area 68 of support portion 66 for temporary storage of bag 82, and/or magazines, or other items, when chair 10 is erected. Bag 82 is of slightly larger dimensions than chair 10 when in the fully folded position, whereby the folded chair may be conveniently slipped into the bag for temporary storage and transportation.

In moving chair 10 from the fully erected position of FIG. 1 to the folded position of FIGS. 2 and 4, the side sections of back portion 12 and seat portion 14 are retracted, i.e., tubular sections 32 are pushed downwardly, into sections 34, and the latter are pushed into sections 36; likewise, sections 42 are telescoped into sections 44. Back portion 12 is then rotated about hinges 20 and 21, and front leg mens 16 is rotated about pins 22 and 23, into superposed relation with seat portion 14, on opposite sides thereof. Rear leg means is pivoted about pins 26 and 27 into superposed relation with front leg means 16. Chair 10 is then placed on one side and the upper side is pushed downwardly, thereby retracting the medial sections of all of the back and seat portions and the front and rear leg means, i.e., tubular sections 38, 46, 52, 58 and 62 are telescoped into sections 40, 48, 54, 60 and 64, respectively.

By way of example, the side sections of back portion 12 preferably have a length of about 24" when fully extended, and about 12" when fully retracted. The side sections of seat portion 14 preferably have a length of about 19" when fully extended, and about 12" when fully retracted. The medial sections of all of back and seat portions 12 and 14, as well as front and rear leg means 16 and 18, and the cross member of the latter, each have a length of about 19" when fully extended and about 12" when fully retracted. The outside diameter of the largest tubular member in each side section (i.e., members 36, 44, 50 and 56) may be about 1", whereby chair 10 in its fully folded position will occupy a space of about 12"×12"×4". Outwardly extending portions 72, 73, 74, 76, 77 and 78 of support portions 66 each have a preferred width of about 10" to 11", whereby these portions which are looped around the chair frame will be compressed very little, if at all, when the chair is fully folded. The inner portions of the fabric of support portion 66 will be folded or "bunched" upon themselves when the chair is folded, without interfering with folding or unfolding movement of the chair.

In the disclosed embodiment, the telescoping tubular members are maintained in the extended position by friction fit. It will be understood, of course, that releasable detent means of various, conventional designs may be provided to permit manually releasable locking means for maintaining the tubular members in their relatively extended positions should such means be found desireable.

What is claimed is:

1. A folding chair construction comprising, in combination:

(a) a back portion of essentially U-shaped configuration including a pair of parallel, first side sections, each connected at one end to opposite ends of a first medial section and extending therefrom to free ends;

(b) a seat portion of essentially U-shaped configuration including a pair of parallel, second side sections each connected at one end to opposite ends of a second medial section and extending therefrom to free ends;

(c) first hinge means connecting said back and seat portions adjacent said free ends of each of said first and second side sections for pivotal movement between relatively folded and erected positions wherein said back and seat portions are in superposed and angularly disposed relation, respectively;

(d) front leg means of essentially U-shaped configuration including a pair of parallel, third side sections, each connected at one end to opposite ends of a third medial section and extending therfrom to free ends;

(e) rear leg means of essentially U-shaped configuration including a pair of parallel, fourth side sections, each connected at one end to opposite ends of a fourth medial section and extending therefrom to free ends;

(f) second hinge means connecting said front leg means and said seat portion adjacent said one ends of said second side sections and said free ends of said third side sections for pivotal movement between respective fold and erected positions wherein said front leg means and said seat portion are in supoerposed and angularly disposed relation, respectively;

(g) third hinge means connecting said rear leg means and said seat portion adjacent said free ends of each of said second and fourth side sections for pivotal movement between respective folded and erected positions wherein said front and rear leg means are in supoerposed relation and said rear leg means and said seat portion are in angularly disposed relation, respectively;

(h) each of said first and second side sections and said first, second, third and fourth medial sections comprising a plurality of tubular members connected in end-to-end relation for axial, telescoping movement between mutually extended and retracted positions; and (i) a unitary support portion of flexible material secured to said first side and medial portions and said second side and medial portions to extend laterally between both of said first and second side sections and longitudinally between said first and second medial sections when said back and seat portions are in said erected position, and said tubular members are in said mutually extended positions.

2. The folding chair construction of claim 1 wherein each of said first, second, third and fourth medial sections consist essentially of two of said tubular members connected for telescoping movement between said extended and retracted positions.

3. The folding chair construction of claim 1 wherein said first side sections each comprise at least three and said second side sections each comprise at least two of said tubular members connected for telescoping movement between said extended and retracted positions.

4. The folding chair construction of claim 3 wherein said first side sections consist essentially of three and said second side sections consist essentially of two of said tubular members connected for telescoping movement between said extended and retracted positions.

5. The folding chair construction of claim 1 wherein said support portion comprises a unitary blank of flexible material forming back and seat areas, said back area having a first plurality of outwardly extending portions looped around both of said first side sections and said first medial section, and said seat area having a second plurality of outwardly extending portions looped around both of said second side sections and said second medial section, each of said first and second pluralities of outwardly extending portions being stitched to themselves, thereby permanently securing said support portion to said back and seat portions.

6. The folding chair construction of claim 5 wherein each of said first and second side sections and said first and second medial sections has a first and a second predetermined length when in said extended and retracted position, respectively, and said outwardly extending portions each have a width not substantially greater than said second predetermined length.

7. The folding chair construction of claim 6 wherein said second predetermined lengths of said first and second side sections and of said first and second medial sections are all substantially equal to one another, and the widths of all of said first and second pluralities of outwardly extending portions are substantially equal to one another.

8. The folding chair construction of claim 7 wherein said first plurality of outwardly extending portions comprises a single such outwardly extended portion looped around each of said first and second side sections and said first and second medial sections.

9. The folding chair construction of claim 8 wherein said first predetermined length of said first side sections is substantially greater than said first predetermined length of said second side sections.

10. The folding chair construction of claim 9 wherein said first predetermined length of said first side sections is between about 20% and about 50% greater than said first predetermined length of said second side sections.

11. The folding chair construction of claim 9 wherein said second predetermined lengths of said first and second side sections and said first and second medial sections are between about 50% and about 75% of said first predetermined length of said second side sections.

12. The folding chair construction of claim 1 wherein said first, second, third and fourth side sections are connected at said one end of each to said first, second, third and fourth medial sections, respectively, by right angle corner members having opposite end portions one of which is permanently secured of said one end of one of said side sections and the other of which is permanently secured to one of said opposite ends of one of said medial sections.

* * * * *